US007712319B2

(12) United States Patent
Braun, II et al.

(10) Patent No.: US 7,712,319 B2
(45) Date of Patent: May 11, 2010

(54) REFRIGERANT CHARGE ADEQUACY GAUGE

(75) Inventors: Robert J. Braun, II, Windsor, CT (US); Pengju Kang, Hartford, CT (US); Julio I. Concha, Rocky Hill, CT (US); Sivakumar Gopalnarayanan, Simsbury, CT (US); Timothy P. Galante, West Hartford, CT (US); Dong Luo, South Windsor, CT (US); Craig Kersten, Mooresville, IN (US)

(73) Assignee: Carrier Corporation, Farmington, CT (US)

( * ) Notice: Subject to any disclaimer, the term of this patent is extended or adjusted under 35 U.S.C. 154(b) by 826 days.

(21) Appl. No.: 11/025,787

(22) Filed: Dec. 27, 2004

(65) Prior Publication Data

US 2006/0137364 A1 Jun. 29, 2006

(51) Int. Cl.
*F25B 49/00* (2006.01)
*F25B 45/00* (2006.01)

(52) U.S. Cl. ..... 62/126; 62/77; 62/149

(58) Field of Classification Search ..... 62/126–130, 62/149, 77; 700/276; 702/182
See application file for complete search history.

(56) References Cited

U.S. PATENT DOCUMENTS 4,381,549 A 4/1983 Stamp, Jr. et al.
4,429,578 A 2/1984 Darrel et al.
4,510,576 A 4/1985 MacArthur et al.
4,561,261 A * 12/1985 Kornrumpf et al. ..... 62/126
4,841,734 A 6/1989 Torrence
5,079,930 A 1/1992 Beaverson et al.
5,156,012 A 10/1992 Kuribara et al.
5,214,918 A 6/1993 Oguni et al.
5,228,304 A 7/1993 Ryan
H1226 H 9/1993 VanReene et al.
5,241,833 A 9/1993 Ohkoshi
5,248,168 A 9/1993 Chichester et al.
5,251,453 A 10/1993 Stanke et al.
5,295,360 A 3/1994 Olds et al.
5,317,903 A * 6/1994 McClelland et al. ..... 62/77
5,341,649 A * 8/1994 Nevitt et al. ..... 62/126
5,354,103 A 10/1994 Torrence et al.
5,362,530 A 11/1994 Kitami et al.
5,374,084 A 12/1994 Potokar
5,381,669 A 1/1995 Bahel et al.
5,406,980 A 4/1995 Allread et al.
5,413,147 A 5/1995 Moreiras et al.
5,425,558 A 6/1995 Dennany, Jr.

(Continued)

FOREIGN PATENT DOCUMENTS

EP 0 159 281 5/1990

(Continued)

*Primary Examiner*—Marc E Norman
(74) *Attorney, Agent, or Firm*—Marjama Muldoon; Blasiak & Sullivan LLP

(57) ABSTRACT

A method and apparatus for determining the sufficiency of refrigerant charge in an air conditioning system by the use of only two temperature measurements. The temperature of the liquid refrigerant leaving the condenser coil is sensed and the temperature of the condenser coil itself is sensed and the difference between these two measurements is calculated to provide an indication of the adequacy of refrigerant charge in the system. This process is refined by steps taken to eliminate measurements during transient operations and by filtering signals to eliminate undesirable noise. A permitted threshold of deviation is calculated by using probability theory.

7 Claims, 3 Drawing Sheets

U.S. PATENT DOCUMENTS

| | | | | |
|---|---|---|---|---|
| 5,463,377 | A | 10/1995 | Kronberg | |
| 5,464,042 | A | 11/1995 | Haunhorst | |
| 5,468,028 | A | 11/1995 | Olson | |
| 5,474,336 | A | 12/1995 | Hoff et al. | |
| 5,540,463 | A | 7/1996 | Potokar | |
| 5,752,726 | A | 5/1998 | Fixemer | |
| 5,834,943 | A | 11/1998 | Miller | |
| 5,868,437 | A | 2/1999 | Teague | |
| 5,961,157 | A | 10/1999 | Baron et al. | |
| 6,012,743 | A | 1/2000 | Godeau et al. | |
| 6,155,612 | A | 12/2000 | Szabo | |
| 6,302,654 | B1 | 10/2001 | Millet et al. | |
| 6,308,523 | B1 | 10/2001 | Scaringe | |
| 6,324,854 | B1 | 12/2001 | Jayanth | |
| 6,330,802 | B1 * | 12/2001 | Cummings et al. | 62/129 |
| 6,354,332 | B1 | 3/2002 | Burkhardt et al. | |
| 6,382,678 | B1 | 5/2002 | Field et al. | |
| 6,442,953 | B1 * | 9/2002 | Trigiani et al. | 62/130 |
| 6,481,756 | B1 | 11/2002 | Field et al. | |
| 6,497,435 | B1 | 12/2002 | Luft et al. | |
| 6,553,774 | B1 * | 4/2003 | Ishio et al. | 62/126 |
| 6,571,566 | B1 * | 6/2003 | Temple et al. | 62/129 |
| 6,594,554 | B1 * | 7/2003 | Seem et al. | 700/276 |
| 6,758,051 | B2 * | 7/2004 | Jayanth et al. | 62/126 |
| 6,868,678 | B2 * | 3/2005 | Mei et al. | 62/126 |
| 7,386,985 | B2 * | 6/2008 | Concha et al. | 62/77 |
| 2002/0024218 | A1 | 2/2002 | Manuli | |
| 2002/0098209 | A1 | 7/2002 | Danielson et al. | |
| 2002/0141877 | A1 * | 10/2002 | Jayanth et al. | 417/63 |
| 2002/0182005 | A1 | 12/2002 | Milhas | |
| 2003/0089119 | A1 | 5/2003 | Pham et al. | |
| 2003/0172665 | A1 * | 9/2003 | Matsuoka et al. | 62/149 |
| 2003/0182950 | A1 | 10/2003 | Mei et al. | |
| 2003/0226367 | A1 * | 12/2003 | Palmer et al. | 62/149 |
| 2005/0229612 | A1 * | 10/2005 | Hrejsa et al. | 62/149 |

FOREIGN PATENT DOCUMENTS

| | | |
|---|---|---|
| EP | 0 308 160 | 6/1991 |
| EP | 0 453 302 | 10/1991 |
| EP | 0 289 369 | 1/1992 |
| EP | 0 396 029 | 9/1992 |
| EP | 0 550 263 | 7/1993 |
| EP | 0 409 000 | 2/1994 |
| EP | 0 529 758 | 6/1996 |
| EP | 0 760 069 | 3/1997 |
| EP | 0 843 794 | 5/1998 |
| EP | 0 918 182 | 5/1999 |
| EP | 1 238 838 | 9/2002 |
| EP | 1 337 825 | 8/2003 |
| GB | 2 274 695 | 8/1994 |
| JP | 62-218748 | 9/1987 |
| JP | 62-261845 | 11/1987 |
| JP | 63-302238 | 12/1988 |
| JP | 2-110268 | 4/1990 |
| JP | 2-195165 | 8/1990 |
| JP | 4-55671 | 2/1992 |
| JP | 4-190062 | 7/1992 |
| JP | 4-273941 | 9/1992 |
| JP | 5-99475 | 4/1993 |
| JP | 5-231754 | 9/1993 |
| JP | 5-256543 | 10/1993 |
| JP | 7-55299 | 3/1995 |
| JP | 8-68576 | 3/1996 |
| JP | 8-261542 | 10/1996 |
| JP | 8-261543 | 10/1996 |
| JP | 2000-9048 | 1/2000 |
| JP | 2000-154954 | 6/2000 |
| JP | 2001-32884 | 2/2001 |
| JP | 2001-141279 | 5/2001 |
| WO | WO 93/20376 | 10/1993 |
| WO | WO 95/30106 | 11/1995 |
| WO | WO 95/30107 | 11/1995 |
| WO | WO 95/33157 | 12/1995 |
| WO | WO 96/17202 | 6/1996 |
| WO | WO 97/12167 | 4/1997 |
| WO | WO 97/13994 | 4/1997 |
| WO | WO 97/13995 | 4/1997 |
| WO | WO 97/47908 | 12/1997 |
| WO | WO 00/45053 | 8/2000 |
| WO | WO 01/23794 | 4/2001 |

* cited by examiner

REFRIGERANT CHARGE ADEQUACY GAUGE

CROSS REFERENCE TO RELATED APPLICATIONS

This application is related to the following applications filed concurrently herewith and assigned to the assignee of the present invention: Ser. Nos. 11/025,353; 11/025,351; 11/025,352; 11/025,788 and 11/025,836.

BACKGROUND OF THE INVENTION

This invention relates generally to air conditioning systems and, more particularly, to an apparatus for determining proper refrigerant charge in such systems.

Maintaining proper refrigerant charge level is essential to the safe and efficient operation of an air conditioning system. Improper charge level, either in deficit or in excess, can cause premature compressor failure. An over-charge in the system results in compressor flooding, which, in turn, may be damaging to the motor and mechanical components. Inadequate refrigerant charge can lead to increased power consumption, thus reducing system capacity and efficiency. Low charge also causes an increase in refrigerant temperature entering the compressor, which may cause thermal over-load of the compressor. Thermal over-load of the compressor can cause degradation of the motor winding insulation, thereby bringing about premature motor failure.

Charge adequacy has traditionally been checked using either the "superheat method" or "subcool method". For air conditioning systems which use a thermal expansion valve (TXV), or an electronic expansion valve (EXV), the superheat of the refrigerant entering the compressor is normally regulated at a fixed value, while the amount of subcooling of the refrigerant exiting the condenser varies. Consequently, the amount of subcooling is used as an indicator for charge level. Manufacturers often specify a range of subcool values for a properly charged air conditioner. For example, a subcool temperature range between 10 and 15° F. is generally regarded as acceptable in residential cooling equipment. For air conditioning systems that use fixed orifice expansion devices instead of TXVs (or EXVs), the performance of the air conditioner is much more sensitive to refrigerant charge level. Therefore, superheat is often used as an indicator for charge in these types of systems. A manual procedure specified by the manufacturer is used to help the installer to determine the actual charge based on either the superheat or subcooling measurement. Table 1 summarizes the measurements required for assessing the proper amount of refrigerant charge.

TABLE 1

Measurements Required for Charge Level Determination

| | Superheat method | Subcooling method |
|---|---|---|
| 1 | Compressor suction temperature | Liquid line temperature at the inlet to expansion device |
| 2 | Compressor suction pressure | Condenser outlet pressure |
| 3 | Outdoor condenser coil entering air temperature | |
| 4 | Indoor returning wet bulb temperature | |

To facilitate the superheat method, the manufacturer provides a table containing the superheat values corresponding to different combinations of indoor return air wet bulb temperatures and outdoor dry bulb temperatures for a properly charged system. This charging procedure is an empirical technique by which the installer determines the charge level by trial-and-error. The field technician has to look up in a table to see if the measured superheat falls in the correct ranges specified in the table. Often the procedure has to be repeated several times to ensure the superheat stays in a correct range specified in the table. Consequently this is a tedious test procedure, and difficult to apply to air conditioners of different makers, or even for equipment of the same maker where different duct and piping configurations are used. In addition, the calculation of superheat or subcool requires the measurement of compressor suction pressure, which requires intrusive penetration of pipes.

In the subcooling method, as with the superheat method, the manufacturer provides a table listing the liquid line temperature required as a function of the amount of subcooling and the liquid line pressure. Once again, the field technician has to look up in the table provided to see if the measured liquid line temperature falls within the correct ranges specified in the table. Thus, this charging procedure is also an empirical, time-consuming, and a trial-and-error process.

SUMMARY OF THE INVENTION

Briefly, in accordance with one aspect of the invention, a simple and inexpensive refrigerant charge inventory indication method is provided using temperature measurements only.

In accordance with another aspect of the invention, the charge inventory level in an air conditioning system is estimated using only the condensing liquid line temperature and the condenser coil temperature. The difference between condensing line temperature and the condenser coil temperature, denoted as CTD (Coil Temperature Difference), is used to derive the adequacy of the charge level in an air conditioning system.

By yet another aspect of the invention, the process is refined by determining when the system is operating under transient conditions and eliminating measurements taken during those periods.

By still another aspect of the invention, the measurements signals are electronically filtered to eliminate undesirable noises therein.

By yet another aspect of the invention, a permitted threshold of deviation form a desired charge level is calculated using probability theory.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
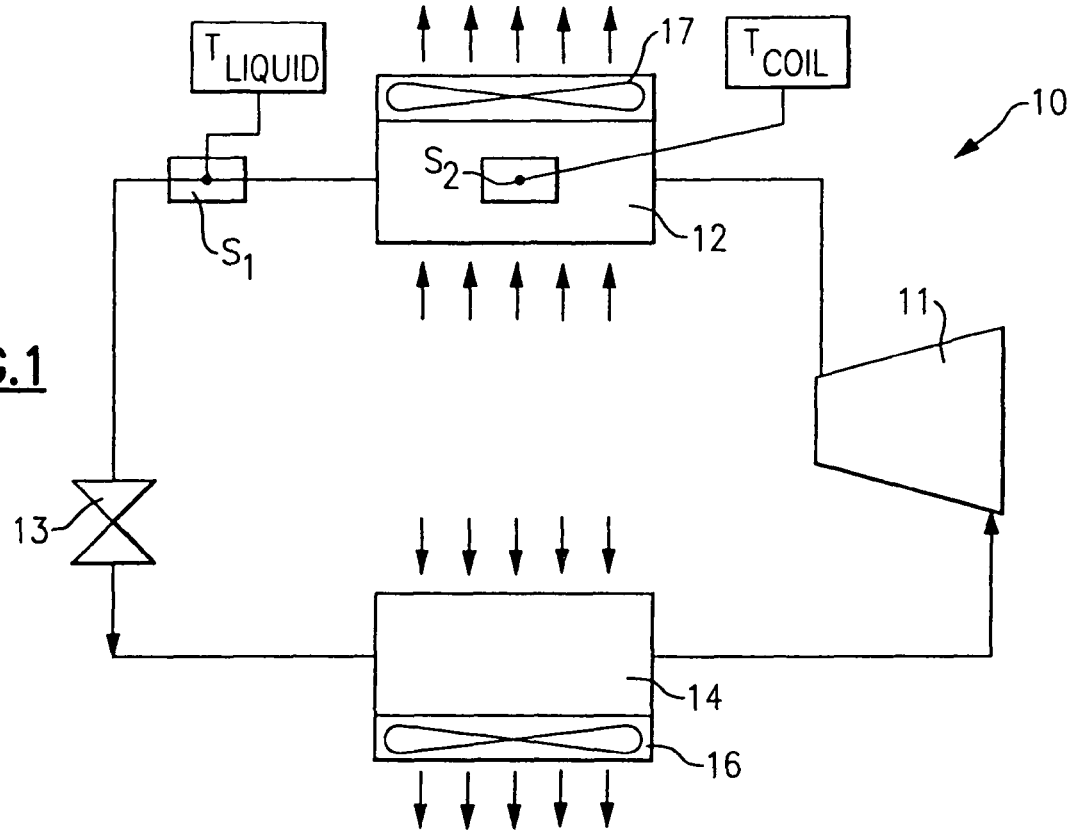
FIG. 1 is a schematic illustration of an air conditioning system with the present invention incorporated therein.

Referring now to FIG. 1, the invention is shown generally at 10 as incorporated into an air conditioning system having a compressor 11, a condenser 12, an expansion device 13 and an evaporator 14. In this regard, it should be recognized that the present invention is equally applicable for use with heat pump systems.

In operation, the refrigerant flowing through the evaporator 14 absorbs the heat in the indoor air being passed over the evaporator coil by the evaporator fan 16, with the cooled air then being circulated back into the indoor area to be cooled. After evaporation, the refrigerant vapor is pressurized in the compressor 11 and the resulting high pressure vapor is condensed into liquid refrigerant at the condenser 12, which rejects the heat in the refrigerant to the outdoor air being circulated over the condenser coil by way of the condenser fan 17. The condensed refrigerant is then expanded by way of the expansion device 13, after which the saturated refrigerant liquid enters the evaporator 14 to continue the cooling process.

In a heat pump, during the cooling mode, the process is identical to that as described hereinabove. In the heating mode, the cycle is reversed with the condenser and evaporator of the cooling mode acting as evaporator and condenser, respectively.

It should be mentioned that the expansion device 13 may be a valve such as a TXV or an EXV which regulates the amount of liquid refrigerant entering the evaporator 14 in response to the superheat condition of the refrigerant entering the compressor 11. However, it may also be a fixed orifice, such as a capillary tube or the like.

In accordance with the present invention, there are only two measured variables needed for assessing the charge level in either a TXV/EXV based air conditioning system or an orifice based air conditioning system. These measured variables are liquid line temperature $T_{liquid}$ and condenser coil temperature $T_{coil}$, which are measured by way of sensors $S_1$ and $S_2$, respectively. These temperature sensors are typically temperature sensitive elements such as a thermister or a thermocouple.

Further, when the liquid line temperature $T_{liquid}$ is subtracted from the condenser coil temperature $T_{coil}$, a "coil temperature difference" (CTD)=$T_{coil}-T_{liquid}$, which is proportional to the amount of subcooling, is obtained, which serves as a surrogate to the amount of subcooling. This alternative method of determining the charge level using CTD, results in a different solution from that of the traditional method but effectively eliminates the need for intrusive pressure measurements at either the liquid service valve or the compressor suction inlet.

Since the CTD that occurs in a system is directly proportional to the amount of refrigerant charge for both orifice and TXV/EXV based systems, the present method provides a convenient and simple indication of charge level with the implementation of low cost, accurate and non-intrusive temperature measurements. Further, since the coil temperature $T_{coil}$ is sensitive to indoor conditions, increased accuracy may be obtained over prior art charge level indicators wherein the charging approach in TXV/EXV systems does not correct for indoor conditions.

It should be recognized that in orifice based systems, wherein a superheat method is normally applied, the present method of using liquid line temperature $T_{liquid}$ and condenser coil temperature $T_{coil}$ does not correlate as strongly with charge level as does the amount of superheat. However, because the indoor conditions are a factor in determining the condenser pressure and therefore the condenser coil temperature $T_{coil}$, sufficient accuracy can be obtained with the present system. Since the condenser coil $T_{coil}$ is sensitive to varying indoor conditions and the CTD is relatively insensitive to outdoor conditions, the present method does not require either indoor or outdoor temperature measurements.

Figure 2:
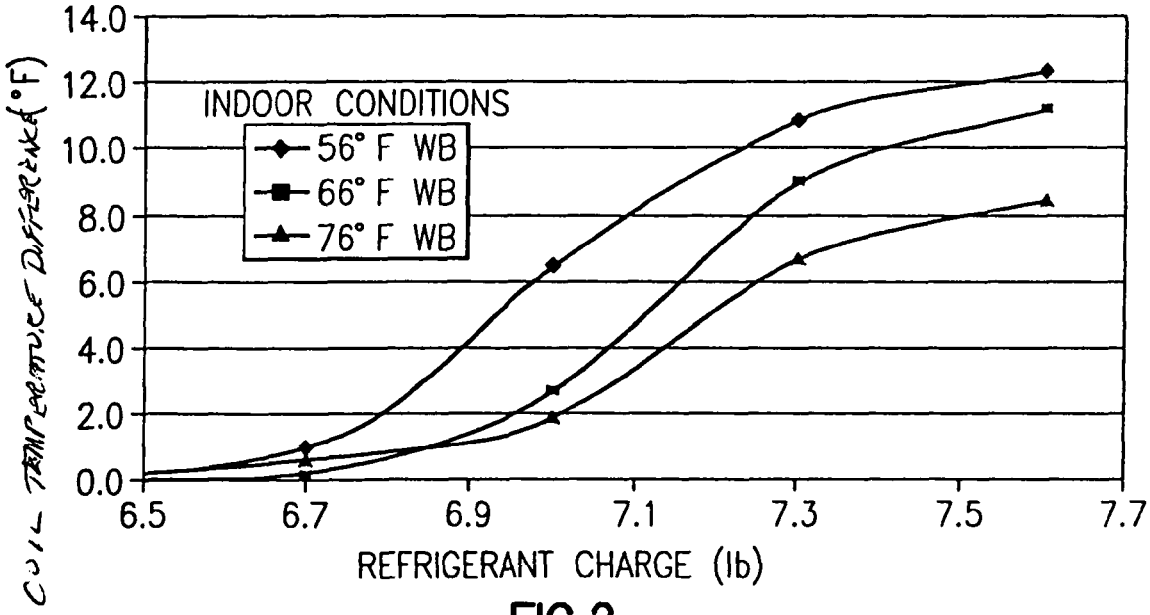
FIG. 2 is a graphic illustration of the relationship, under various indoor conditions, between refrigerant charge and the coil temperature difference between condenser coil ($T_{coil}$) and the liquid line ($T_{LL}$) in an air conditioning system having a TXV incorporated therein in accordance with the present invention.
Figure 3:
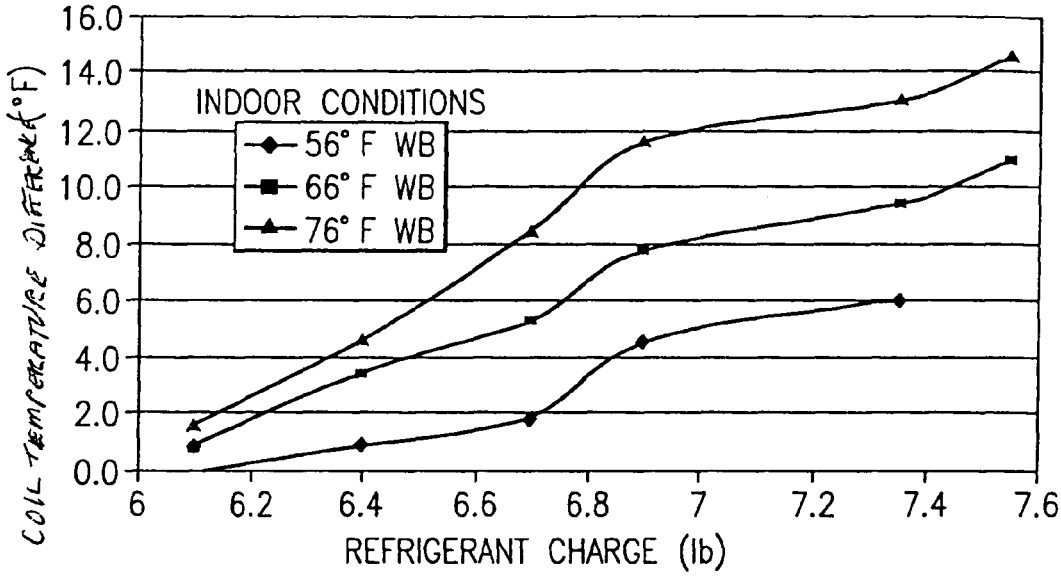
FIG. 3 is a graphic illustration of the relationship, under various indoor conditions, between refrigerant charge and the coil temperature difference ($T_{coil}-T_{LL}$) for an air conditioning system having an orifice incorporated therein in accordance with the present invention.

The present concept for use of a coil temperature measurement rather than a pressure measurement has been demonstrated in the laboratory as shown by the graphic illustrations of FIGS. 2 and 3. In FIG. 2, data is shown for the operation of a 2½ ton air conditioning unit with a TXV at 95° F. outdoor temperature with three different indoor conditions as shown. The CTD was plotted as a function of refrigerant charge in the system.

Similarly, in FIG. 3, a 2½ ton air conditioning unit with an orifice was run at an outdoor temperature of 75° F. under three different indoor conditions, with the amount of CTD being plotted as a function of refrigerant charge.

While the data shown in FIGS. 2 and 3 would indicate that the amount of CTD as indicative of the refrigerant charge level in a system is dependent on indoor conditions, a particular system can be characterized so as to provide a useful correlation between the CTD and the adequacy of the refrigerant charge, irrespective of indoor conditions. This is particularly true because of the dependency of the condenser coil temperature $T_{coil}$ on the indoor conditions as discussed hereinabove. For example, considering that a typical amount of CTD as determined by the conventional approach discussed hereinabove is typically in the range of 10-15°, a particular system may be characterized as having a proper refrigerant charge when the amount of CTD is equal to 10° for example.

If it is desired to have greater accuracy than that which is obtained by the simple and inexpensive approach as discussed hereinabove, it is possible to implement an algorithm for more precisely obtaining the desired information relative to proper refrigerant charge in the system. Further refine the process to consider optional sensor inputs such as indoor conditions.

The detailed algorithm for the charging procedure is described as follows with reference to FIGS. 4 and 5. The disclosed charging algorithm is developed with the following objectives and constraints being taken into consideration:

1. Estimating charge when the unit is in a steady-state, since during transients, measurement of temperature difference CTD is inaccurate, consequently, meaningless in representing charge.

2. Providing adequate indication of the unit's charge status to the operator.

3. Being robust to erroneous readings due to various sources of noise, e.g. small fluctuations in the sensors themselves, electrical noise in the data acquisition circuit, etc.

4. Being as accurate as possible, while minimizing the time required for charging to unit.

The method by which these objective are achieved are discussed below.

Transients. During start-up and shutdown, the CTD is not directly related to the refrigerant charge, due to the transient behavior of the relevant temperatures. The inventive method accounts for this by automatically detecting transients and ignoring the CTD in such cases. The transients are detected by a combination of two methods. In the first place, it is known in advance approximately how long the unit takes to reach a steady condition for typical installations. Therefore, a timer is started when the unit is turned on, and the device waits for a specified period of time. Secondly, it is well known that the standard deviation of a variable indicates the degree to which it is not constant. Therefore, the device calculates the standard deviation of the CTD over a sliding window comprising the last few minutes of operation. IF the standard deviation is greater than a certain predetermined threshold, the device infers that the unit is undergoing transient operation, and the charge indication function is deactivated or discounted.

Status indication. The charge status of the unit is indicated to the operator by appropriate means, such as an LCD display, lights, etc. As shown in FIG. 4, six status modes can be defined: "add charge fast", "add charge slow", "wait", "OK", "recover charge slow", and "recover charge fast".

Figure 5:
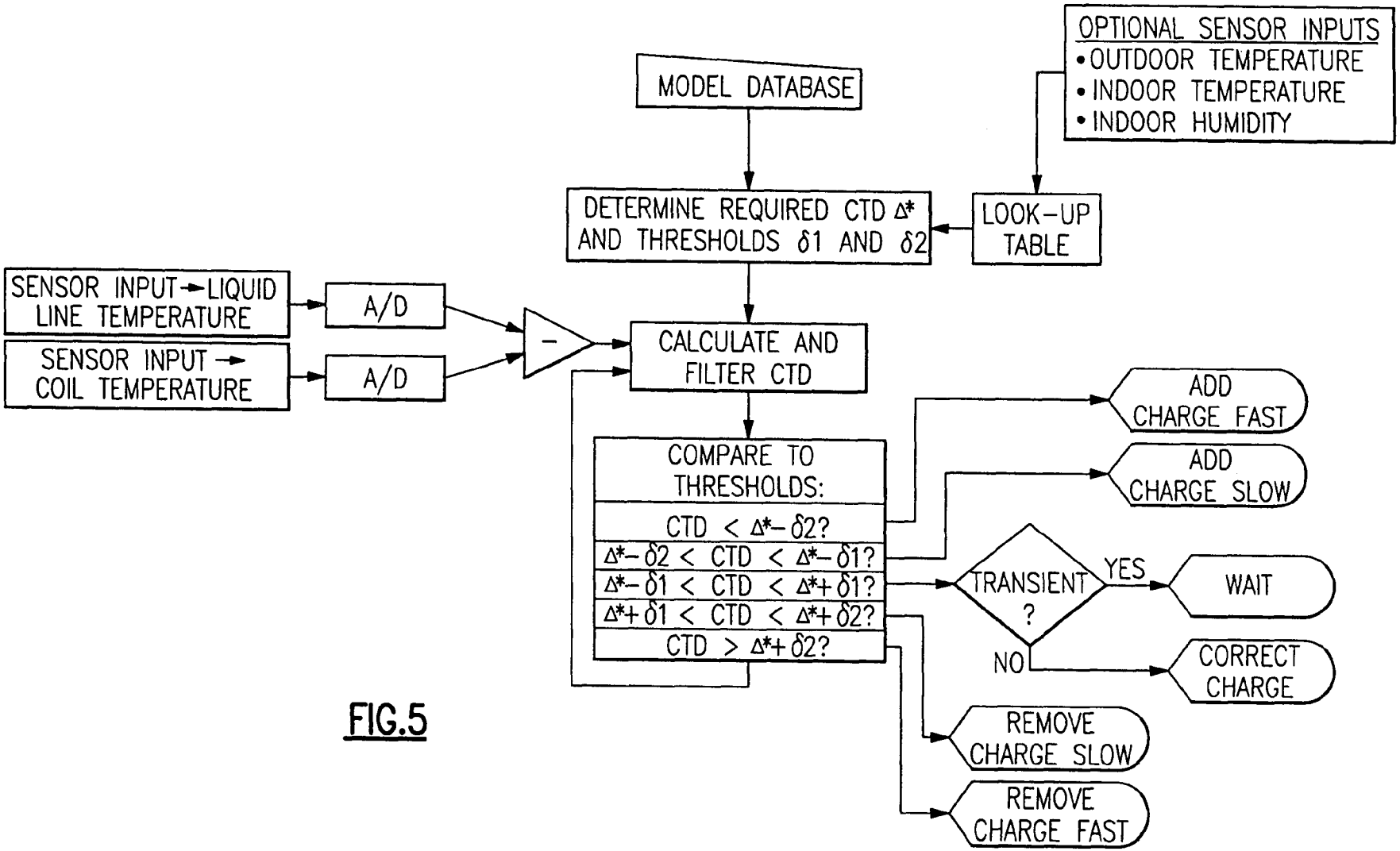
FIG. 5 is a flow chart of the charging procedure embodied in the present invention.

As shown in FIG. 5, the current mode is selected by comparing the current CTD with four thresholds: $\Delta^*\pm\delta\mathbf{1}$, $\Delta^*\pm\delta\mathbf{2}$. The corresponding actions are depicted in FIG. 5. $\Delta^*$ is the target value of the CTD. The way in which the thresholds are selected is discussed.

When the value of the CTD transitions into the range $\Delta^*\pm\delta\mathbf{1}$, the mode is "Wait" rather than "OK". This is to ensure that the seemingly correct value of the CTD is stable in time, rather than an effect of noise or a transient. The mode goes to "OK" only after a pre-defined waiting time and/or it has been established that the unit is under steady operation, as discussed above.

Figure 4:
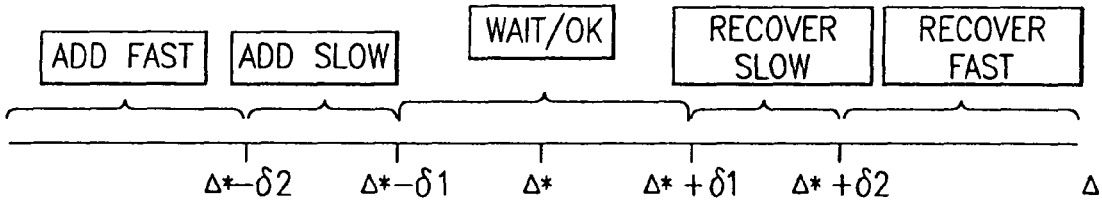
FIG. 4 is a graphic representation of the relationship between the variations in CTD and that of charge status in accordance with the present invention.

The entire charging procedure is illustrated in FIG. 4, which gives a graphic representation of the relationship between the CTD and the charge status. The correct charge corresponds to a certain value $\Delta^*$, within some tolerance.

Robustness to noise. The measured value of the CTD can oscillate rapidly even under a steady operating condition, due to noise in the temperature sensors and in the data acquisition circuit. This causes spurious threshold crossings and can lead to charging inaccuracy. Low-pass analog and/or digital filtering provides robustness against high frequency noise. The filter can also be chosen to have a notch characteristic if the noise is mainly at a single frequency; for example, 50 Hz or 60 Hz.

Figure 6:
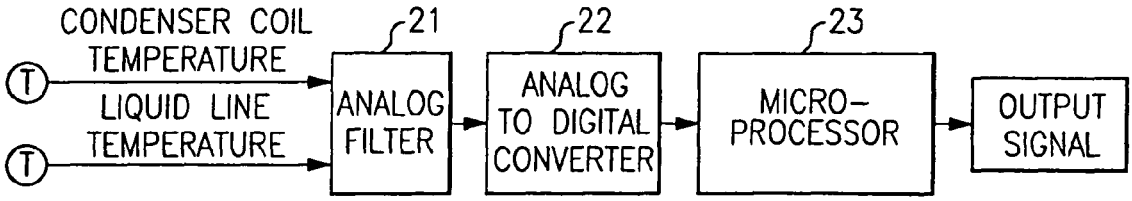
FIG. 6 is a schematic illustration of the circuit block diagram of a charge testing device in accordance with the present invention.

As shown in FIG. 6 analog filtering is implemented by an analog filter 21 before the analog-to-digital converter 22. Digital filtering is implemented in software in the microprocessor 23. The sampling frequency should be selected appropriately high, and the filter delay should be small, so that the temperature changes associated with adding and recovering charge are immediately visible in the filtered signal. Methods for designing low-pass or notch filters with the desired features will be apparent to a person skilled in the art.

Selection of parameters and charging accuracy. The charging method depends critically on the parameters $\Delta^*$, $\delta\mathbf{1}$ and $\delta\mathbf{2}$. These parameters can be chosen to meet certain performance criteria. Specifically, the charge should be as accurate as possible. Too much charge can result in compressor flooding, and too little charge reduces the unit's energy efficiency. On the other hand, the charging process should be reasonably fast, i.e. the method should not ask the installer to go through many trial-and-error add/recover iterations. These objectives are controlled by the design parameter $\delta\mathbf{1}$: if $\delta\mathbf{1}$ is small, the charge indication is more accurate, but getting to the correct value is more difficult. The inventive method specifies an algorithm to compute an appropriate $\delta\mathbf{1}$.

The target value $\Delta^*$ can be chosen to correspond to the desired amount of refrigerant charge, by using an experimental or model-based relationship between refrigerant charge and CTD. However, it can also be chosen slightly higher, since the unit's energy efficiency is less sensitive to overcharging than to undercharging. An acceptable range for the CTD, e.g. $\Delta^*\pm\delta$ ° F., should also be defined in terms of an acceptable range for the charge.

It is possible that the measured CTD is far from the target, even though the true CTD is not. This is called a "false alarm", and may be due to sensor bias, sensor noise and quantization and arithmetic errors. A desirable requirement is that, if the true CTD is within $\delta$ ° F. of the target $\Delta^*$, the method should indicate that the charge is correct at least 95% of the time. This corresponds to a "false alarm" probability $P_F=0.05$. The required threshold $\delta\mathbf{1}$ can be computed from this by using probability theory. Specifically, denote the measured CTD by $\Delta_m$. Let the true value of the CTD be $\Delta$, and let the sensor bias be b. An assumption common in statistics is that $\Delta_m$ is a Gaussian random variable with mean $\Delta$+b and variance $\sigma^2$. The required threshold $\delta\mathbf{1}$ can be computed as $$\delta 1=\delta+b_{max}+F^{-1}((1-P_F)^{1/N})$$

where:

F is the cumulative distribution function of a zero-mean Gaussian random variable with variance $\sigma^2$.

$b_{max}$ is the maximum value of the sensor bias, usually obtained from manufacturers' specifications.

N is the number of samples that are taken before making a decision. For example, if the system makes one measurement per second and waits for one minute, then N=60.

The degree of accuracy of the method can be defined as the 95% confidence interval for the CTD. This is the interval $\Delta^*\pm\delta_{max}$ such that, if the CTD is outside of it, the method will detect this fact 95% of the time. The value of $\delta_{max}$ is $$\delta_{max}=\delta+2b_{max}+F^{-1}((1-P_F)^{1/N})-F^{-1}((1-P_D)^{1/N})$$

where $P_D=0.95$ is the probability of detection. This can be translated into a 95% confidence interval for the amount of refrigerant charge, by using the same experimental or model-based relationship previously discussed.

The value of $\delta\mathbf{2}$ is less critical. It can be selected simply as $\delta\mathbf{2}=\delta\mathbf{1}+3$° F. or so.

Ambient conditions. As discussed above, the CTD also depends on indoor and outdoor ambient conditions such as temperature and humidity. If higher charge accuracy is desired, the inventive method can be readily modified to take into account the ambient conditions. Specifically, the target CTD can be made to depend on the ambient conditions instead of being a constant. Additional sensors are required to measure the indoor and/or outdoor temperature and humidity. Using these measurements, the target CTD can be computed using a look-up table. This table is determined in advance from an experimental and/or model-based relationship between the desired refrigerant charge and the CTD, for each ambient condition. Alternatively, this relationship can be embodied in a mathematical equation, such as a polynomial, that gives the target CTD for given ambient conditions.

While the present invention has been particularly shown and described with reference to preferred and alternate embodiments as illustrated in the drawings, it will be understood by one skilled in the art that various changes in detail may be effected therein without departing from the true spirit and scope of the invention as defined by the claims.

We claim:

1. A method of determining the sufficiency of refrigerant charge in an air conditioning system having a compressor, a condenser coil, an expansion device and an evaporator coil fluidly interconnected in serial refrigerant flow relationship, comprising the steps of:

measuring the temperature of the liquid refrigerant line leaving the condenser coil;

measuring the temperature of the condenser coil;

computing the coil temperature difference by subtracting the liquid refrigerant line temperature from the condenser coil temperature;

using only the computed coil temperature difference, being greater than a prescribed level to determine if the refrigerant charge therein is sufficient; and changing a level of the refrigerant charge in the air conditioning system based on the determination.

2. A method as set forth in claim 1 wherein said expansion device is a thermal expansion valve/electronic expansion valve.

3. A method as set forth in claim 1 wherein said expansion device is a fixed orifice device.

4. A method as set forth in claim 1, comprising:

repeating the measuring the temperature of the liquid refrigerant line through the using only the computed coil temperature difference steps.

5. Apparatus for determining the sufficiency of refrigerant charge in an air conditioning system having a compressor, a condenser coil, an expansion device and a evaporator coil fluidly interconnected in serial refrigerant flow relationship comprising:

a temperature sensor for sensing the temperature of the liquid refrigerant line leaving the condenser;

a temperature sensor for sensing the temperature of the condenser coil;

a comparator for computing a coil temperature difference by subtracting the liquid refrigerant line temperature from the condenser coil temperature; and means for using only the computed coil temperature difference, together with empirical data, to determine if the refrigerant charge therein is sufficient.

6. Apparatus as set forth in claim 5 wherein said expansion device is a thermal expansion valve/electronic expansion valve.

7. Apparatus as set forth in claim 5 wherein said expansion device is a fixed orifice device.

* * * * *